US011200783B2

(12) United States Patent
Funk

(10) Patent No.: US 11,200,783 B2
(45) Date of Patent: Dec. 14, 2021

(54) SELECTIVE EXCHANGE OF AVAILABLE GAMING SEGMENTS TO ENHANCE PAYOUT POTENTIAL IN OTHER GAMING SEGMENTS

(71) Applicant: KING SHOW GAMES, INC., Minnetonka, MN (US)

(72) Inventor: Steven Funk, Rosemount, MN (US)

( * ) Notice: Subject to any disclaimer, the term of this patent is extended or adjusted under 35 U.S.C. 154(b) by 0 days.

(21) Appl. No.: 16/831,220

(22) Filed: Mar. 26, 2020

(65) Prior Publication Data

US 2020/0312097 A1 Oct. 1, 2020

Related U.S. Application Data

(60) Provisional application No. 62/824,731, filed on Mar. 27, 2019.

(51) Int. Cl.
*G07F 17/32* (2006.01)

(52) U.S. Cl.
CPC ..... *G07F 17/3267* (2013.01); *G07F 17/3244* (2013.01); *G07F 17/3265* (2013.01); *G07F 17/3293* (2013.01)

(58) Field of Classification Search
USPC ..... 463/13, 12, 11
See application file for complete search history.

(56) References Cited

U.S. PATENT DOCUMENTS

| | | | | |
|---|---|---|---|---|
| 6,620,045 | B2 | 9/2003 | Berman et al. | |
| 7,704,142 | B2 | 4/2010 | Berman | |
| 2015/0170474 | A1 | 6/2015 | Schugar | |
| 2018/0089949 | A1 | 3/2018 | Moody | |
| 2020/0160663 | A1* | 5/2020 | Berman | G07F 17/3262 |
| 2020/0160667 | A1* | 5/2020 | Berman | G07F 17/3293 |
| 2020/0312084 | A1* | 10/2020 | Bradley | G07F 17/34 |

* cited by examiner

*Primary Examiner* — Pierre E Elisca

(57) ABSTRACT

Systems, apparatuses and methods for exchanging awarded or otherwise provided gaming segments for opportunities to enhance payouts in other gaming segments. In the context of electronic/video poker games, the poker system facilitates exchanging one or more concurrently-played poker hands for an opportunity(s) to enhance potential payouts associated with one or more other concurrently-played poker hands.

20 Claims, 8 Drawing Sheets

SELECTIVE EXCHANGE OF AVAILABLE GAMING SEGMENTS TO ENHANCE PAYOUT POTENTIAL IN OTHER GAMING SEGMENTS

FIELD

This disclosure relates generally to games, and more particularly to systems, apparatuses and methods for exchanging awarded or otherwise provided gaming segments for opportunities to enhance payouts in other gaming segments.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to exchange first gaming segments for opportunities to enhance payouts in second gaming segments.

In one embodiment, the systems, apparatuses and methods relate to poker games, such as video poker games, where the poker system facilitates trading one or more poker hands for an opportunity(s) to enhance potential payouts associated with one or more other poker hands.

In accordance with one embodiment, a gaming device is provided for facilitating player participation in a poker game. The gaming device includes a display, a user interface configured to receive at least player input to facilitate player participation in the poker game, and a wager input device structured to identify and validate player assets and permit the player to play the poker game when the player assets are provided. The gaming device further includes a processor configured to cause the display to visually present multiple concurrently-played draw poker hands in response to the player assets being allocated via the wager input device. The processor is configured to facilitate the player holding one or more cards of a first one of the plurality of draw poker hands, and to replicate any held cards into remaining ones of the draw poker hands. The processor is configured to present, via the display, a player-selectable option for the player to trade/exchange participation in one or more of the remaining draw poker hands other than the first draw poker hand, in exchange for a payout modifier to be applied to any payouts arising from the final (e.g. post-draw/post-replacement) hands of the first draw poker hand and the remaining draw poker hands where participation was not traded. The processor is configured to provide replacement cards for what was not held in the first draw poker hand, and to provide replacement cards for the cards not replicated in the remaining draw poker hands where participation was not traded, thereby creating the final hands of the first draw poker hand and the remaining draw poker hands where participation was not traded. The processor is configured to apply the payout modifier to the payouts arising from the final hands of the first draw poker hand and the remaining draw poker hands where participation was not traded.

In some embodiments, the player may opt to hold no cards, whereby no cards will be replicated.

In one embodiment, the payout modifier comprises a multiplier, where the processor is configured to apply the multiplier to the payouts arising from the final hands of the first draw poker hand and the remaining draw poker hands where participation was not traded. In a more particular embodiment, the value of the multiplier is dependent on the number of draw poker hands that are traded. In still another embodiment, the value of the multiplier increases with an increasing number of the draw poker hands that are traded.

In accordance with another embodiment of such a gaming device, the processor is configured to present the selectable option for the player to trade in response to particular ones of the cards being presented in the first draw poker hand. In another embodiment, the processor is configured to present the selectable option for the player to trade in response to a poker rank of the cards presented in the first draw poker hand. In an alternative embodiment, the processor is configured to randomly determine whether to present the selectable option for the player to trade.

In another embodiment of such a gaming device, the processor is further configured to add one or more additional concurrently-played draw poker hands for participation by the player, in response to particular cards, or card rank, or suit/card rank, or other card-based criteria being presented via the dealt first draw poker hand. In such an embodiment, the processor may be further configured to present the selectable option for the player to trade participation in any of the remaining draw poker hands and the additional concurrently-played draw poker hands, in exchange for the payout modifier to apply to any of the payouts arising from the final hands of the first draw poker hand, the remaining draw poker hands where participation was not traded, and the additional concurrently-played draw poker hands where participation was not traded. In a more particular embodiment, the payout modifier is generally increased as the number of the remaining draw poker hands and the additional concurrently-played draw poker hands that are traded increases.

In another embodiment, the processor is configured to provide no payout modifier if the player chooses not to trade any of the remaining ones of the draw poker hands not including the first draw poker hand.

In accordance with another embodiment, a gaming device for facilitating player participation in a poker game is provided. The gaming device includes a display, a user interface configured to receive at least player input to facilitate player participation in the poker game, and a wager input device structured to identify and validate player assets and permit the player to play the poker game when the player assets are provided. The gaming device further includes a processor configured to cause the display to visually present multiple concurrently-played draw poker hands in response to the player assets being allocated via the wager input device, where the concurrently-played draw poker hands includes a first draw poker hand and one or more remaining draw poker hands. The processor is configured to determine whether a triggering event occurred in connection with the first draw poker hand, and if so, to award one or more additional draw poker hands for concurrent play. The processor is configured to facilitate the player holding of zero, one, or more cards of the first draw poker hand, and to replicate any held cards into both the remaining draw poker hands and the additional draw poker hands. The processor is further configured to present a selectable option for the player to trade participation in one or more of the awarded additional draw poker hands, in exchange for a payout modifier to apply to any payouts arising from final hands of the first draw poker hand, the remaining draw poker hands, and any of the awarded additional draw poker hands where participation was not traded. The processor is configured to provide replacement cards for the cards that were not held in the first draw poker hand, for the cards that were not replicated in the remaining draw poker hands, and for the cards that were not replicated in the awarded additional draw poker hands where participation was not traded. The processor is configured to create the final hands for the first draw poker hand, the remaining draw poker hands, and the awarded additional draw poker hands where participation was not traded, using the held and replacement cards. The processor is further configured to apply the payout modifier to enhance the payouts arising from the first draw poker hand, the remaining draw poker hands, and the awarded additional draw poker hands where participation was not traded.

In another embodiment of such a gaming device, the processor is configured to present the selectable option for the player to additionally trade participation in one or more of the remaining draw hands, in exchange for the payout modifier to apply to any payouts arising from the final hands of the first draw poker hand, the remaining draw poker hands, and any of the awarded additional draw poker hands where participation was not traded. The processor is further configured to apply the payout modifier to enhance the payouts arising from the final hands of the first draw poker hand, the remaining draw poker hands where participation was not traded, and the awarded additional draw poker hands where participation was not traded.

In accordance with another embodiment, the payout modifier comprises a multiplier, and the processor is configured to apply the multiplier to the payouts arising from the final hands of the first draw poker hand, the remaining draw poker hands where participation was not traded, and the awarded additional draw poker hands where participation was not traded.

In still another embodiment, the payout modifier comprises a multiplier, and the processor is configured to apply the multiplier to the payouts arising from the final hands of the first draw poker hand, and arising from the awarded additional draw poker hands where participation was not traded.

In another embodiment, the value of the multiplier is dependent on a number of the awarded additional draw poker hands that are traded. In a more particular embodiment, the value of the multiplier increases with an increasing number of the awarded additional draw poker hands that are traded.

In still another embodiment, the processor is configured to present the selectable option for the player to trade in response to particular ones of the cards being presented in the first draw poker hand. In another embodiment, the processor is configured to present the selectable option for the player to trade in response to a poker rank of the cards presented in the first draw poker hand. In an alternative embodiment, the processor is configured to randomly determine whether to present the selectable option for the player to trade.

In still another embodiment, the processor is configured to provide no additional draw poker hands if it is determined that the triggering event did not occur.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

DETAILED DESCRIPTION

Figure 1:
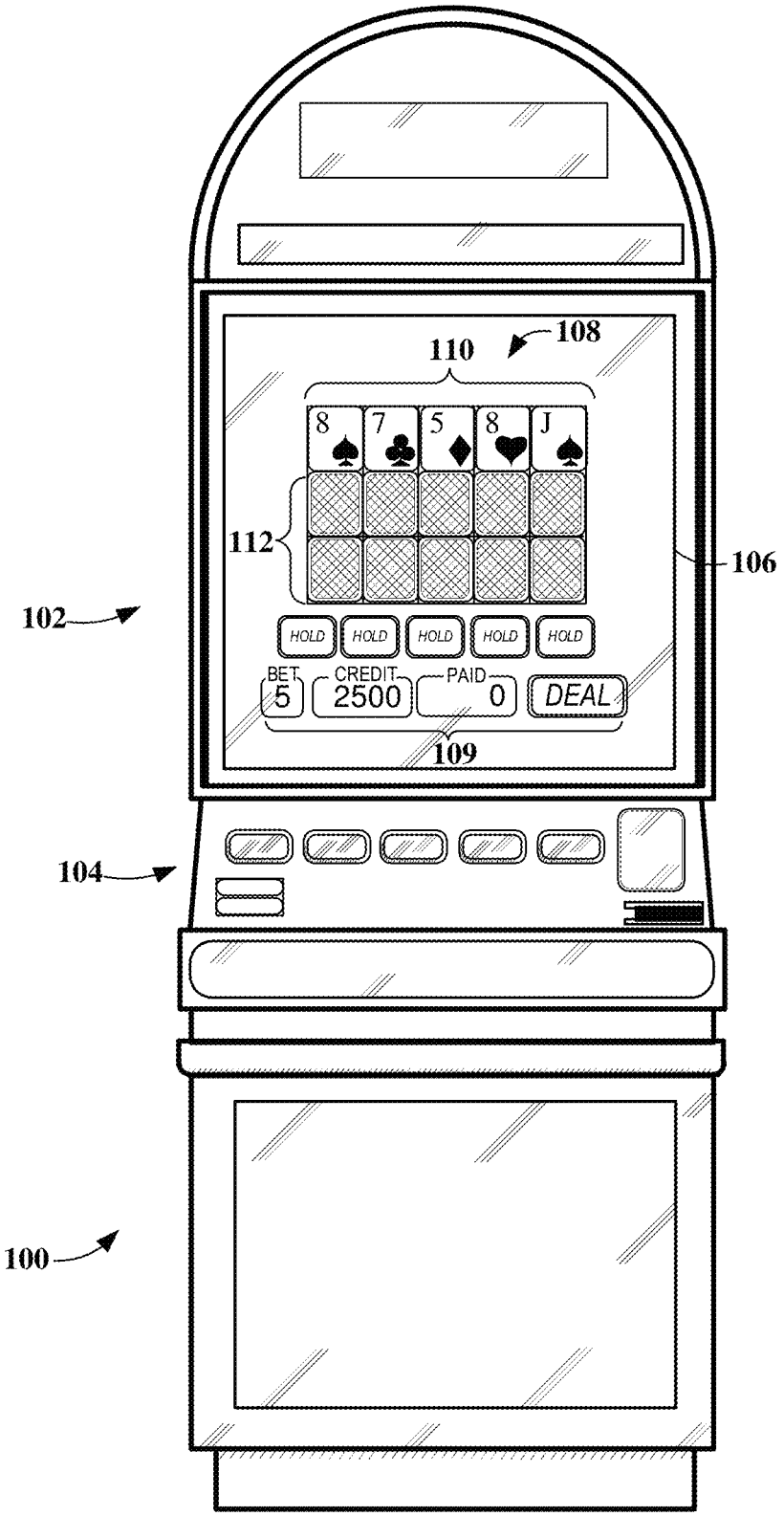
FIG. 1 is a diagram of a representative gaming machine capable of facilitating player use and interaction with games and features in accordance with the invention and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are disclosed for facilitating relinquishment of one or more otherwise playable poker hands or other gaming events in exchange for a payout modifier(s) and/or other feature that may beneficially enhance the payouts relating to the remaining poker hands or other gaming events. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. poker, such as video poker) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that involves enabling portions of a gaming activity to be exchanged for other a potentially greater return on the portions of the gaming activity that were not traded away. Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve electronic/video poker examples of this concept, other embodiments include application of these inventive techniques in of slot games, other card games, roulette, bingo, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some embodiments described herein, the primary gaming portion 108 may display a grid(s) or equivalent arrangement(s) of playing cards 110 forming one or more hands or other sets of cards in a card game, such as a poker game. In the illustrated example, a set of five playing cards 110 forms a video poker hand, which represents a portion of a game play event. For example, if the game play event is a video draw poker game, the gaming device 100 may deal five cards, allow the user to select cards to hold, deal replacements for the cards not held, and determine a payout based on the final cards in the hand. The illustration and description of five-card draw poker is for purposes of example and not of limitation, as the disclosure is applicable to numerous other card games, such as stud poker or hold 'em poker, as well as other types of gaming activities and apparatuses, such as slot machines, dice, coins, etc. For example, some embodiments may relate to slot games, where the primary gaming portion 108 presents a grid (or equivalent arrangement) of symbols or other game elements in respective symbol locations (not shown), where the symbols or combinations of symbols determine gaming outcomes.

In some embodiments, the primary gaming portion 108 may also display one or more additional hands 112 of playing cards, such as in a multi-play poker embodiment. For example, one multi-play poker embodiment involves draw poker, where at least one hand 110 is dealt, and cards held by the player in hand 110 are replicated into one or more other hands 112, whereby all hands 110, 112 may then be completed with replacement cards while having one or more commonly held cards. Multi-play embodiments may also be played without holding any cards, and/or without replication of held cards into other hands. In some embodiments, other hands 112 may represent discrete, individually-played additional hands of cards that are unrelated to the play of other hands 110.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual cards to hold and/or selection of individual cards to discard and replace (e.g., in a draw poker embodiment), which subset of cards of a larger set of cards to hold/use for a final hand(s) (e.g., in some stud poker embodiments), wagering inputs, etc. The game display 106 of the display area 102 may include other features that are not shown, such as pay tables, navigation controls, etc.

Figure 2:
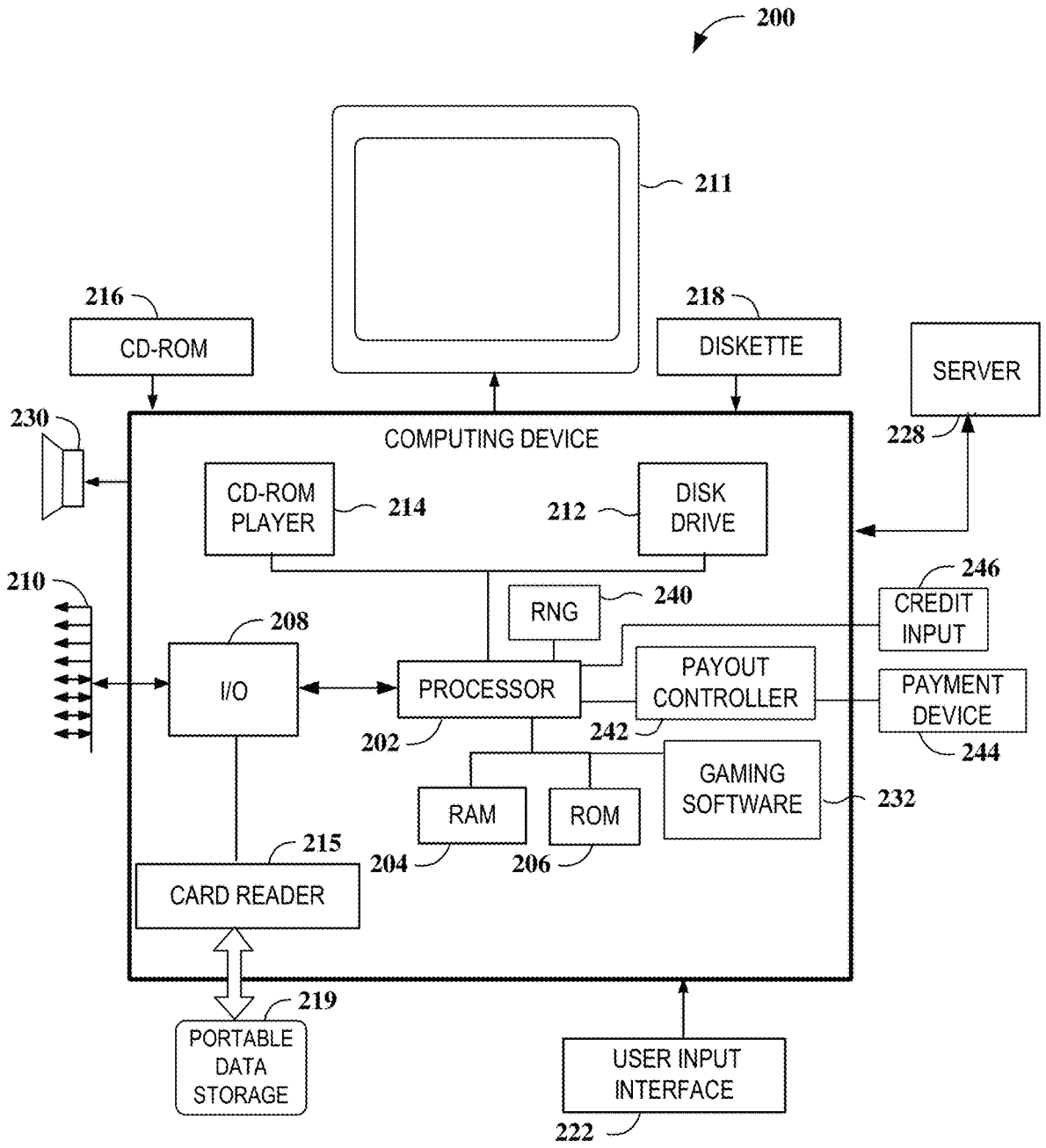
FIG. 2 is a block diagram illustrating a representative computing arrangement capable of implementing games and features in accordance with the invention and representative embodiments described herein.

Although FIG. 1 illustrates a particular implementation of some of the embodiments in a casino or electronic gaming machine ("EGM"), one or more devices may be programmed to play various embodiments of the disclosure. The concepts and embodiments described herein may be implemented, as shown in FIG. 1, as an electronic/video gaming machine or other special purpose gaming kiosk, or may be implemented via computing systems operating under the direction of local gaming software, and/or remotely-provided software such as provided by an application service provider (ASP). Such gaming machines may also utilize computing systems to control and manage the gaming activity, although these computing systems typically include specialized components and/or functionality to operate the particular elements of electronic gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor(s), such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display, or an electronic/video display such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in, for example, one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. In one embodiment, the gaming devices and systems facilitate player decisions regarding whether to trade some subset of available gaming events for a chance(s) to win a higher award on another subset of the available gaming events. Many embodiments may be described in terms of an electronic poker game, where presented cards potentially form a result(s) that conforms to a predetermined winning outcome to determine payout awards. However, the principles described herein are equally applicable to other games of chance, as described herein and as will be readily apparent to those skilled in the art from the teachings herein.

Figure 3A:
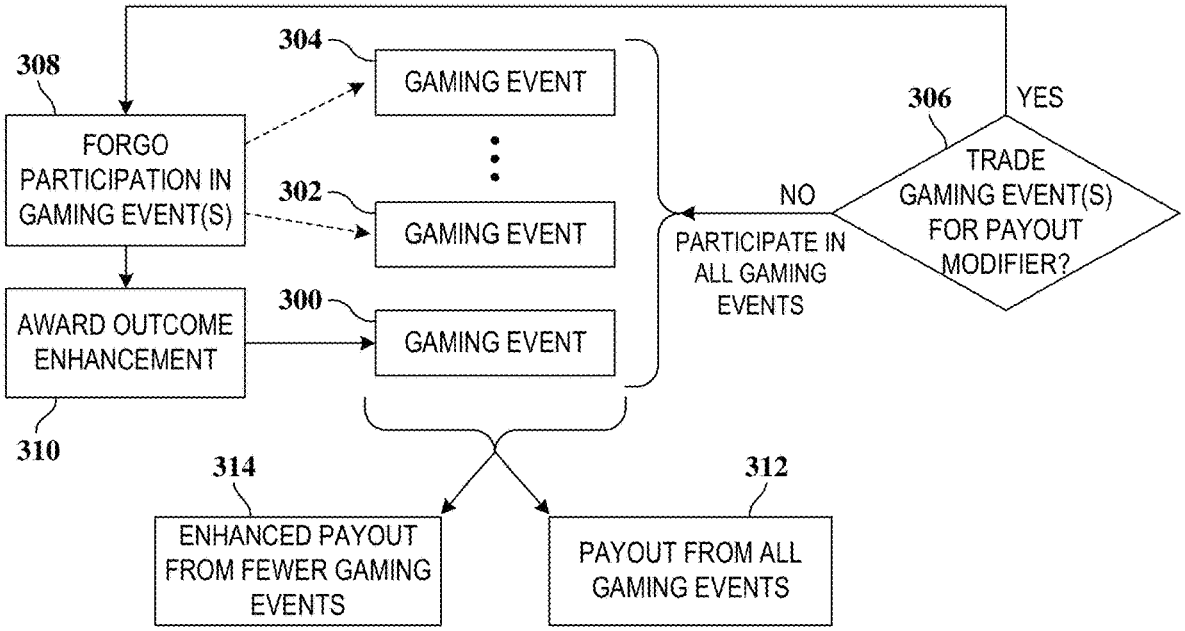
FIG. 3A depicts a representative manner of facilitating the selective exchange of a first subset of gaming events to enhance the payout potential in another subset of gaming events.

FIG. 3A is described in the context of a gaming activity that includes a plurality of gaming events. The gaming activity may be slot game games, poker or other card-related games, keno, roulette, bingo, or other gaming activities. In this embodiment, a first gaming event 300 occurs, such as a slot game reel spin event, dealt poker hand, etc. In the current example, one or more other gaming events 302 through 304 are also presented, and may be presented as part of the base game (e.g. triple-play or multi-play poker), or may be other gaming events that were awarded during play (e.g. free spins awarded in a slot game), or may be any other secondary, complementary, or auxiliary gaming events associated with a gaming activity, whether on the current game play or a subsequent game play. In the illustrated example, it is assumed that the one or more other gaming events 302 through 304 are associated with a current gaming activity, where one or more of gaming events 302 through 304 are part of the base game (e.g. multi-play poker), or awarded or otherwise provided during participation in the gaming event 300 or other part of the gaming activity (e.g. awarded as free plays, etc.).

Any of the gaming events 300, 302, 304 may be eligible for exchanging for a player benefit. In the illustrated example, it is assumed that gaming event 300 is not eligible to exchange for a player benefit(s), but gaming events 302 through 304 are eligible to exchange for a player benefit(s). Again, gaming events 302 through 304 may be provided as part of the base game and still eligible for exchange, or may be provided randomly, periodically, in response to a game play action(s), etc. For example, in one embodiment, one or more of gaming events 302 through 304 may be provided as a result of some occurrence in the base game, such as obtaining a particular card or cards, or card combination, or random indicia (e.g. symbol or sub-symbol on a card(s)), etc. In such a case, the player is awarded with one or more additional gaming events 302, 304, and is provided an opportunity to exchange one, more, or all of such additional gaming events 302, 304 for some other player benefit.

In the present example of FIG. 3A, for whatever reason that one or more additional gaming events 302, 304 or other play segment are provided, the player is provided with an opportunity to exchange or trade 306 one or more of the available gaming events (302 through 304 in this example) for a player benefit. Such player benefit may be free games, payout modifiers, enriched paytables, enriched game elements (e.g. slot reels with increased number and/or percentage of higher award or other result potential), and the like. In the illustrated embodiment, it is assumed for purposes of illustration that the player benefit is a payout modifier, such as a multiplier or other mathematical function applicable to a payout(s) that can increase that payout(s) as a result of application of the payout modifier.

In one embodiment, the player may be presented with an option to trade 306 such gaming event(s) for a payout modifier (or other player benefit), while in other embodiments the trade may automatically occur, while in other embodiments the trade will occur if certain criteria is met, etc. In the illustrated embodiment, the player is provided an option whether to trade 306 one or more gaming events 302, 304 in exchange for a payout modifier(s) that may be used in connection with payouts with remaining, active gaming events such as gaming event 300. If the player chooses not to trade any gaming events for a payout modifier(s) usable in another gaming event(s) 300, then all gaming events 300, 302, 304 will be available for the player to participate in. On the other hand, if the player opts to trade 306 one or more of the gaming events, such as gaming events 302, 304, for a payout modifier(s) to use in connection with any potential payouts that might occur for the remaining gaming event(s) 300, the player will forgo 308 participation in one or more of the gaming events 302, 304. As a result of giving up participation in one or more gaming events 302, 304, the player is provided with an award outcome enhancement 310, such as, for example, a payout modifier to apply to any payout that might occur next (and/or in the future in some embodiments) for gaming event 300.

More particularly, in one embodiment, if the player opts not to trade 306 any gaming events 302, 304 for a payout modifier, the player will participate in the available gaming events 300, 302, 304, and will receive a corresponding payout 312 (if any) from all of the gaming events. If the player opts to trade 306 one or more gaming events 302, 304 for a payout modifier, the player will participate in fewer gaming events (e.g. gaming event 300), but will in turn receive an enhanced payout 314 from those fewer gaming events.

As an example, assume that a slot game is played, where a first gaming event 300 corresponds to a payline that was paid to play by the player. Assume that two other paylines are also active, corresponding to gaming events 302 and 304, as a result of the initial number of paylines paid for, based on a side bet, awarded to the player as a result of something occurring in connection with the slot game (e.g. a random symbol/indicator occurs, the player is awarded the additional two gaming events 302, 304 as a result of a symbol combination or other indicator associated with gaming event 300, etc.), etc. The player could choose to trade 306 those additional two payline opportunities (or other benefit, such as free spins, etc.), in exchange for a payout modifier that can be applied to, for example, any result associated with the gaming event 300. For example, the player might opt to trade 306 gaming events 302, 304, and be awarded a 5× multiplier (where the payout modifier value may be known to the player before the decision to trade 306, or may be random after the player's decision to trade 306, etc.). If the player then wins a payout of 100 credits via gaming event 300, the total award would be 500 credits (5×100 credits). The player thus, in this embodiment, decides whether playing more of the gaming events 300, 302, 304 might produce a larger total payout than a fewer number of gaming events (e.g. 300) enhanced by the payout modifier.

In one embodiment, a portion, but not all, of the gaming event(s) 300 is revealed at the time the decision to trade 306 is presented. For example, a subset of all of the reels associated with a payline could stop, thereby providing the player with some, but not all, of the information that could identify payout potentials on that payline(s) associated with a first one or more of the gaming events 300. That subset of the reels might also, in some embodiments, present some of the information that could identify payout potentials on other paylines associated with other gaming events 302, 304. Such embodiments further impact the player's decisions whether to trade some subset of the available gaming events for a chance(s) to win a higher award on another subset of the available gaming events.

Figure 3B:
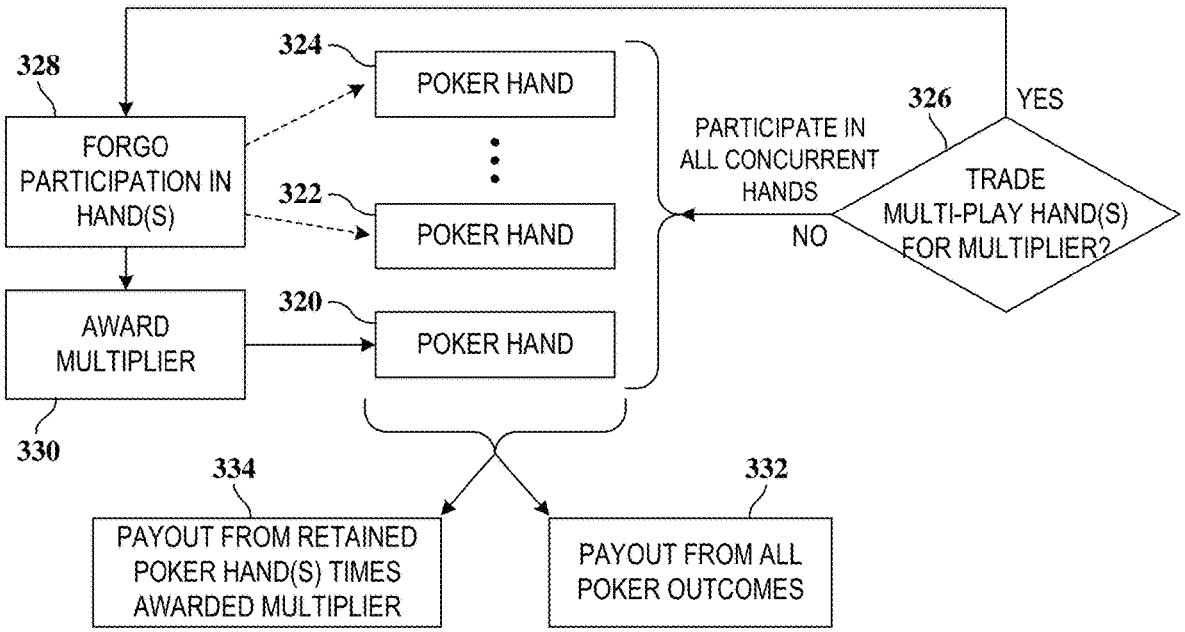
FIG. 3B depicts a representative manner of facilitating the selective exchange of available poker hands to enhance the payout potential in other available poker hands.

FIG. 3B depicts a representative manner of facilitating the selective exchange of available poker hands to enhance the payout potential in other available poker hands. At least a first poker hand 320 is dealt. In one embodiment, a multi-play poker game is played, where one or more additional poker hands 322 through 324 represent poker hands that are concurrently played with a base poker hand(s) 320. In one representative multi-play poker format, an initial hand is dealt (e.g. poker hand 320), and cards held in the initial hand are replicated into the other hands (e.g. poker hands 322, 324), whereby non-held and non-replicated cards are then drawn to form final hands. For example, in a triple-play poker version, three hands would be dealt (e.g. poker hands 320, 322, 324), where the player would hold cards in one of those hands (e.g. 320) that would be replicated in the other hands (e.g. 322, 324).

In one embodiment, one or more of the "other" hands that are played concurrently, such as poker hands 322, 324, may be part of the original deal. In other words, in such an embodiment, poker hands 320, 322, and 324 are dealt in connection with a single poker activity/deal. As described more fully below, the player may be able to trade one or more of the hands 320, 322, 324 (one, some, or all of hands 322 through 324 in this example) to get a payout modifier to apply to the remaining hand(s) (hand 320 in this example).

In another embodiment, one or more of the "other" hands that are played concurrently (e.g. poker hands 322, 324) may not be part of the original deal, but rather are provided during play or otherwise in connection with play. For example, poker hand 320 may be played individually, with no multi-play context, but during play an award or other feature is presented to enable one or more other poker hands 322-324 to be presented for play. In such an embodiment, the player may be able to trade one or more of the hands 320, 322, 324 (one, some, or all of hands 322 through 324 in this example) to get a payout modifier to apply to the remaining hand(s) (hand 320 in this example). In such an embodiment, the player would be allowed to trade back one or more poker hands 322, 324 that were just won or otherwise obtained in connection with play of another poker hand(s) 320.

In still another embodiment, a subset of the "other" hands that are played concurrently (e.g. poker hands 322, 324) may not be part of the original deal, but rather is/are provided during play or otherwise in connection with play. For example, poker hand 320 may be played in a multi-play format with at least one other poker hand 322, but during play an award or other feature is presented to enable one or more other poker hands (e.g. any number of poker hands through poker hand 324) to be presented for play. In such an embodiment, the player may be able to trade one or more of the hands 320, 322, 324 (such as any of the concurrent hands 322 of the multi-play poker and/or any of the awarded/presented hands 324) to get a payout modifier to apply to the remaining hand(s) (e.g. poker hand 320 in this example). In such an embodiment, the player would be allowed to trade back one or more poker hands 322, 324 that were concurrently-played hands in a multi-play context and/or were just won or otherwise obtained in connection with play of another poker hand(s) 320.

For purposes of illustration, the example of FIG. 3B will assume a multi-play poker embodiment, where poker hand 320 represents the originally dealt hand, poker hand 322 serves as a single concurrently-played poker hand in a multi-play environment, and at least one additional poker hand 324 represents an additional poker hand awarded to the player for any reason associated with the poker activity (e.g. poker hand 320 meets a threshold for poker rank and/or particular cards prior to holding/replacing cards in that poker hand 320). In such case, the player may trade 326 one or more of the poker hands 322, 324 in this embodiment. If no poker hands are traded 326, the player will participate in all available poker hands 320, 322, 324, and the payout 332 will be based on all of the poker hand 320, 322, 324 outcomes. On the other hand, if the player chooses to trade 326 participation in one or more of the poker hand(s) 322, 324 to obtain a multiplier, the player will forgo 328 participation in that hand(s), and the player will be awarded 330 a multiplier (in this example) or other player benefit in return.

In one embodiment, such received player benefit is that payouts from retained poker hands (e.g. at least poker hand 320 in this example) are multiplied by a multiplier 334 awarded in response to relinquishing participation in the traded poker hands (e.g. poker hands 322, 324).

In one embodiment, the multiplier or other payout modifier, or other player benefit(s), may be at least somewhat proportional to the number of poker hands traded. For example, if the player is given the opportunity to trade one or both of poker hands 322, 324, and opts to trade 326 one of those, the player may be awarded a first multiplier 334, such as a 2× multiplier. If the player is given the opportunity to trade one or both of poker hands 322, 324, and opts to trade 326 both of the poker hands 322, 324, the player may be awarded a second multiplier 334 that is higher than the first multiplier, such as a 5× multiplier. Therefore, embodiments contemplate adjusting the multiplier, payout modifier, and/or other player benefit based on the degree to which the player relinquished participation in gaming events.

The ability to be able to make a trade for a payout modifier or other player benefit may be set as desired. A threshold poker rank on the first/initial hand may trigger the option, in some cases any time the threshold poker rank occurs, where in other cases only if some other action is or had been taken, such as placing a maximum wager, placing a side bet, etc. In some embodiments, the trade feature is available on every play, where in other embodiments it occurs randomly, or if/when a side bet or particular (e.g. maximum) wager is made, or if initial hand card or poker rank criteria is met, etc.

Figure 4A:
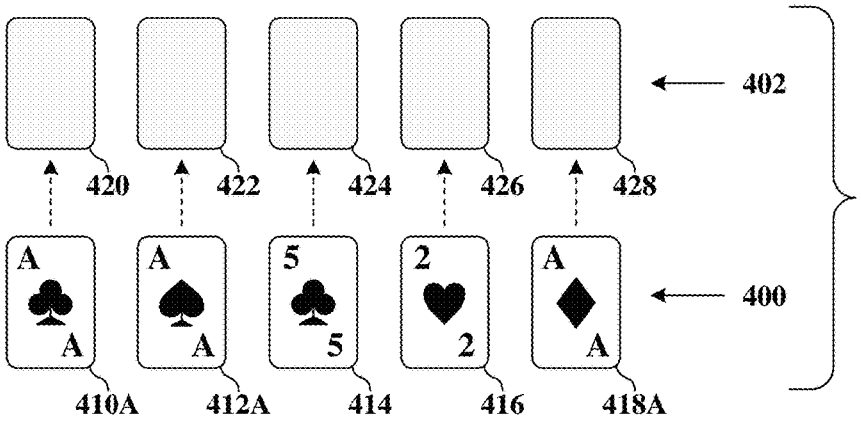
FIGS. 4A, 4B and 4C depict a representative example of a selective exchange opportunity in a video poker environment where one or more poker hands may be exchanged for a chance to increase a payout in one or more other poker hands.
Figure 4B:
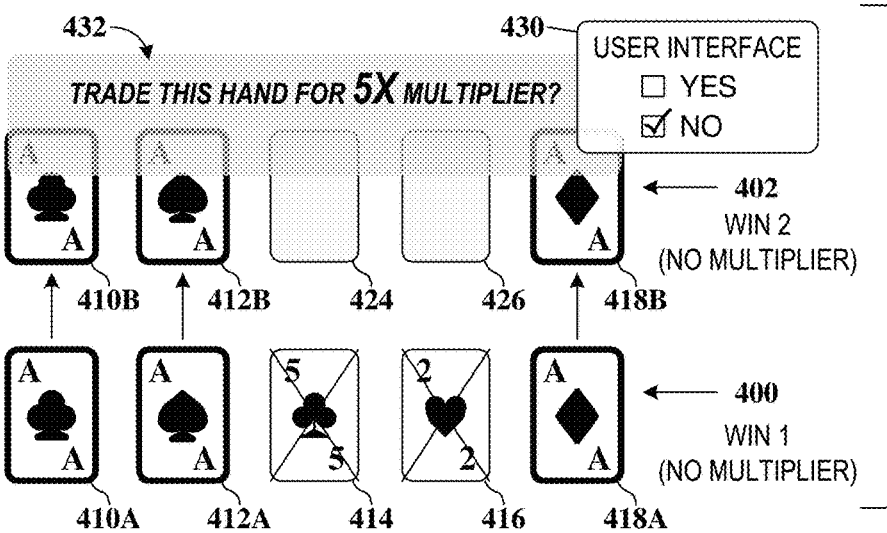
Figure 4C:
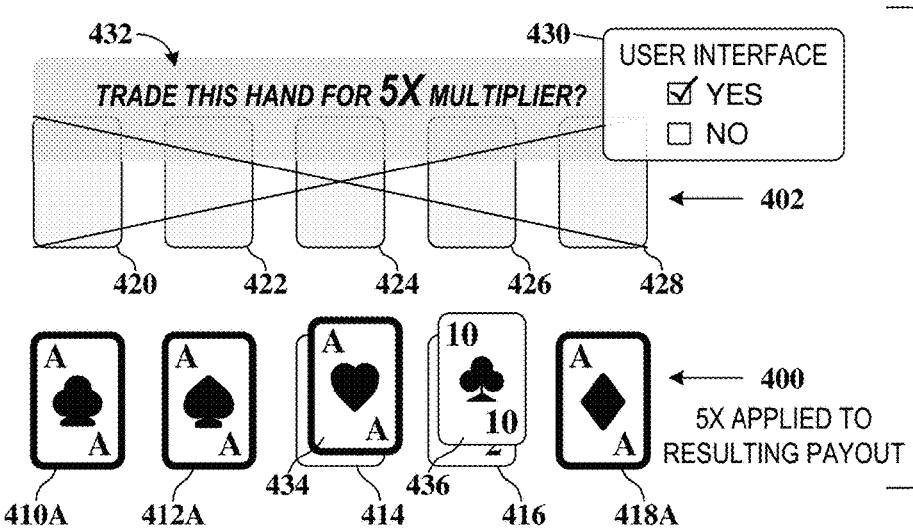

FIGS. 4A, 4B and 4C depict a representative example of a selective exchange opportunity in a video poker environment where one or more poker hands may be exchanged for a chance(s) to increase a payout(s) in one or more other poker hands. The representative embodiment assumes a "multi-play" context, where at least one hand 402 is dealt in addition to an initial hand 400. The number of additional, concurrently-played hands may vary in a multi-play embodiment, and may be as few as one additional hand, or as many as desired. In one embodiment, cards held in the initial hand 400 are replicated into the one or more additional hands 402, and cards are then drawn in each of the hands to complete each hand 400, 402. However, in other embodiments, where multiple hands are concurrently played, the hands 400, 402 may be discrete and have no dependence on one another (e.g. such as replicating held cards), and are therefore each played individually. Also, while the example of FIGS. 4A-4C suggests a draw poker variety, the principles described herein are equally applicable to stud poker or any other poker variation where at least one additional poker hand is available for an exchange. In still other embodiments, an additional poker hand(s) may not represent the item(s) to be exchanged, but rather other items may be traded (e.g. payout modifiers, free games, etc.).

In the example of FIG. 4A, the first hand 400 is revealed, and includes cards 410A, 412A, 414, 416, 418A. Another hand 402 is provided, that includes cards (or alternatively card positions) 420, 422, 424, 426, 428. For purposes of illustration, the present embodiment assumes a multi-play poker game, where the additional hand(s) 402 is provided in connection with the game. For example, additional hand 402 may be provided automatically as part of the base game, whereby the player is then allowed to exchange that additional hand(s) 402 in exchange for a payout modifier(s) usable in connection with the initial hand 400. In another representative embodiment, the additional hand 402 may be provided as a response to something happening in connection with the initial hand 400. For example, in one embodiment, a single hand 400 may be played, and if a particular poker rank appears on the cards 410A, 412A, 414, 416, 418A (e.g. three Aces or higher), an additional hand 402 is awarded for play, whereby the player is then allowed to not accept that additional hand(s) 402 in exchange for a payout modifier(s) usable in connection with the initial hand 400.

FIG. 4B depicts an example where the player is given an opportunity to exchange at least one additional hand 402 for a payout modifier that may be used for a payout from initial hand 400. In this example, criteria is used to determine whether the player will be given the option to exchange a hand(s) (or other player asset) for a payout modifier (or other player asset) for use with a remaining hand(s) 400. However, such criteria is not implemented in other embodiments, where the option to make such an exchange may be afforded every time, or randomly, or periodically, etc. However, in the illustrated embodiment, it is assumed that criteria exists to present the player with the chance to exchange a hand(s) for a payout modifier(s), such as the initial hand 400 already presenting cards that will result in some payout, even before the draw. For example, a criterium may be that any cards in the initial hand 400 already meeting a payout criteria, such as three Aces 410A, 412A, 418A in the illustrated embodiment, qualify for the opportunity to exchange another hand(s) 402 for a payout modifier(s) usable in the initial hand 400.

Thus, in the example of FIG. 4B, the criteria is met (i.e., three Aces 410A, 412A, 418A already qualify for a payout for three-of-a-kind), and therefore the player is at least presented with an opportunity to make the exchange, as depicted by user interface entry 430. Other information may also be presented, such as information 432 directing the player to make the decision (e.g. "trade this hand for 5× multiplier"). In various embodiments, the value of the multiplier or other payout modifier (or other player asset) provided is dependent upon the cards held, the poker rank of the cards held, the payout available for the cards held, the number of additional hands 402 relinquished in favor of a payout modifier (e.g. where one hand relinquished provides a 2× multiplier; ten hands relinquished provides a 10× multiplier, etc.), the number of additional hands not relinquished, the potential payout of the initial hand 400 based on the held cards, a fixed value, etc.

In the embodiment of FIG. 4B, the player has elected not to trade hand 402 for a 5× multiplier, as denoted via user interface 430. Therefore, hands 400 and 402 are both played and remain active, yet no payout modifier (in connection with this feature) is provided. As seen in FIG. 4B, initial hand 400 includes three Aces 410A, 412A, 418A which have been held, and replicated into the additional hand 402 as Aces 410B, 412B, 418B. Cards 414 and 416 from hand 400 will be discarded in favor of replacement/draw cards, and cards 424, 426 from hand 402 will receive replacement/draw cards. As can be seen, both hands will result in at least three-of-a-kind in Aces, since both hands 400, 402 already include three Aces, but both hands have the opportunity to increase the poker rank from three-of-a-kind to a full house or four-of-a-kind (in this example). Therefore, the player in the embodiment of FIG. 4B chose not to trade hand 402 to obtain a 5× multiplier usable with the result of hand 400.

In the alternative embodiment of FIG. 4C, the player has elected to trade hand 402 for a 5× multiplier, as denoted via user interface 430. In this case, hand 402 is withdrawn from availability to the player, thereby leaving the player with the remaining hand 400. However, by exchanging the hand 402, the player has received a 5× multiplier (in this example) to apply to any payout occurring via the remaining hands, which is hand 400 in the illustrated embodiment. Thus, the player may be hoping that obtaining a full house or four-of-a-kind in the first hand 400, multiplied by the obtained 5× multiplier, will produce a greater total payout than had the player opted to not accept the trade and instead play both hands 400, 402 without an awarded multiplier. In the illustrated example, the player held Aces 410A, 412A and 418A, and discarded cards 414 and 416, whereby the drawn replacement cards 434 and 436 replace original cards 414, 416. In this example, the replacement card 414 is an Ace of Hearts, and the replacement card 436 is a Ten of Clubs. Therefore, the player has received four-of-a-kind in Aces as a result of initial hand 400, and has received a 5× multiplier as a result of giving up participation in hand 402. If four-of-a-kind in Aces provides a 500 credit payout (for example), the player would then receive 2500 credits (5×500).

In some embodiments, the player may trade one or more additional hands 402 for something other than a payout modifier. For example, in one embodiment, such a trade may be made for a modified paytable rather than a payout modifier, such as a paytable that increases the payout for at least those poker hands potentially available based on the held cards (e.g. increased paytable for at least a full house and four-of-a-kind in Aces in the example of FIG. 4C). In some embodiments, such a trade may increase the payouts for all winning poker hands in a paytable, rather than just those poker hands that are currently met or could be met based on the cards that were held. In another embodiment, the player may trade a hand(s) for some number of free games or other player benefits. Thus, it should be recognized that the player may trade hands for player assets other than payout modifiers.

Figure 5:
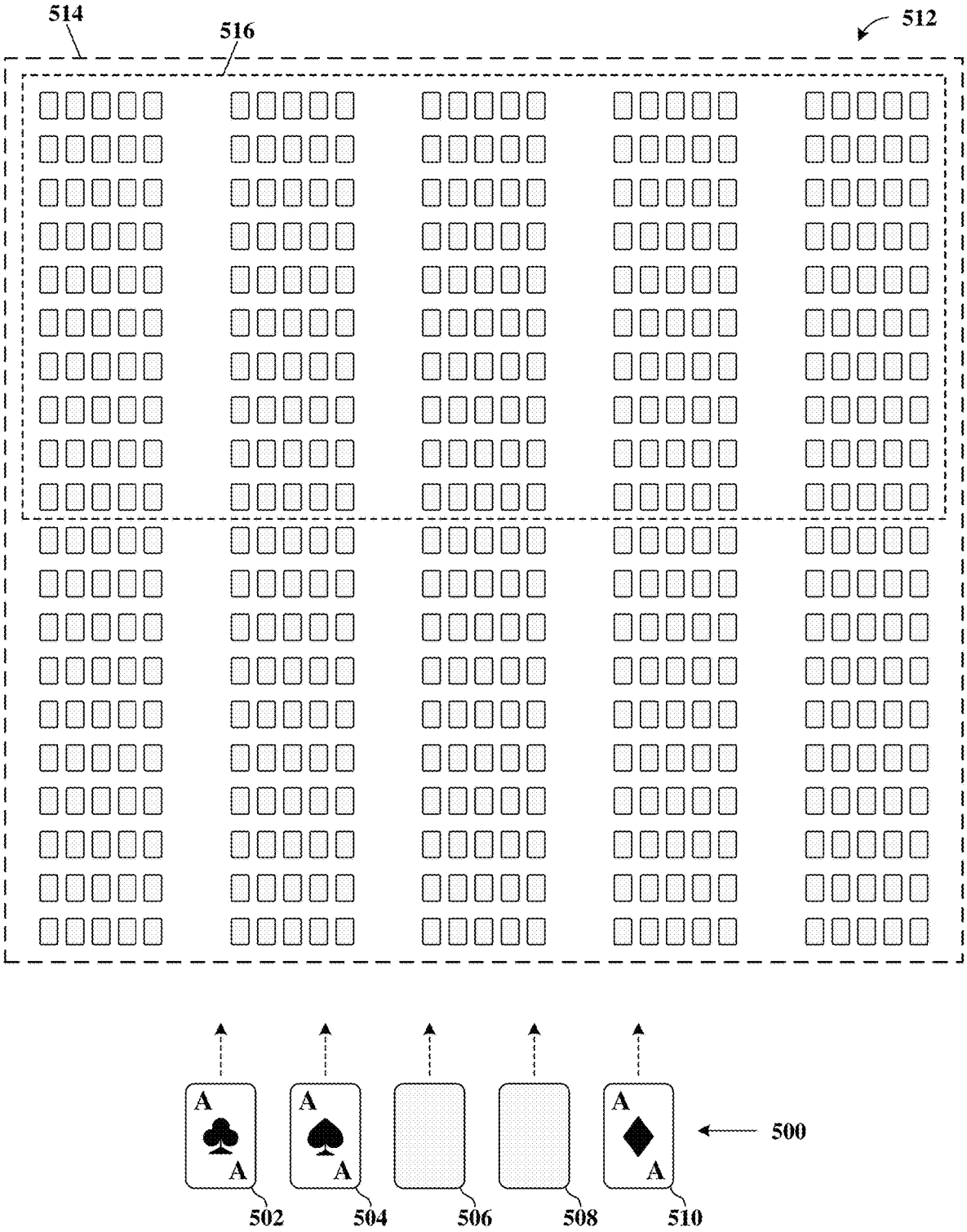
FIG. 5 depicts another representative embodiment of a multi-play poker game, where subsets of the concurrently-played hands may be exchanged for payout modifiers usable with retained hands.

FIG. 5 depicts another representative embodiment of a multi-play poker game, where subsets of the concurrently-played hands may be exchanged for player assets such as payout modifiers usable with retained hands. An initial hand 500 is provided that includes cards 502, 504, 506, 508 and 510. The depicted embodiment is a multi-play embodiment with a large number of concurrently-played hands—one hundred concurrently-played hands 512 in the illustrated embodiment. In such an embodiment, if the player holds cards 502, 504 and 510, those cards 502, 504 and 510 will be replicated into each of the one-hundred hands 512. In accordance with one embodiment, the player may elect to trade one, more, or even all of the hands 512 for a payout modifier(s) that is applied to payouts from the remaining hand 500 and in some embodiments to other concurrently-played hands 512 that were not traded.

For example, the player may choose to exchange all one-hundred of the additional hands 512 for a payout modifier that may be used to enhance a payout from the initial hand 500. In one embodiment, the value of the modifier may be loosely, or specifically, dependent on the number of hands 512 traded by the player. For example, trading all one-hundred additional hands 512 as depicted by dashed line 514 may provide the player with a 100× multiplier, so that any payout from the hand 500 will be multiplied by one-hundred. Thus, if the player drew another Ace for either card 506, 508 that paid 500 credits, the player would receive 50,000 credits (100×500).

As another example, trading half (fifty in this example) additional hands 512 as depicted by dashed line 516 may provide the player with a 25× multiplier, so that any payout from at least the hand 500 will be multiplied by fifty. In another embodiment, the 25× multiplier may also be applied to those additional hands 512 that were not traded, thereby providing the player with about half the number of hands to play while obtaining a multiplier to apply to those hands 500, 512 that remain. In some embodiments, the multiplier applied to the initial hand 500 may differ from a multiplier provided and applied to remaining hands 512 that were not traded.

In some embodiments, the multiplier (or other payout modifier or player asset) may be specifically dependent on the number of hands traded, such as a 1× multiplier (i.e. no multiplier) if one hand is traded, a 2× multiplier if two hands are traded, and so forth. In another embodiment, the multiplier may move in stages, such as trading 1-10 hands 512 provides a 2× multiplier, trading 11-20 hands 512 provides a 5× multiplier, and so forth. As another example, in a triple-play poker embodiment (one initial hand, and two additional concurrently-played hands), trading one of the two additional hands may provide (for example) a 2× multiplier to be used for payouts from at least the initial hand (and also the retained additional hand in some embodiments), while trading both of the two additional hands may provide (for example) a 5× multiplier to be used for payouts from the initial hand.

In one embodiment, one, more or all of the additional hands 512 may be provided in response to some triggering event associated with one or more of the hands, such as with initial hand 500. For example, if a particular poker rank threshold is met (e.g. three-of-a-kind), then some number of additional hands 512 may be provided. In such an embodiment, the player may then be allowed to trade none, one, or up to all of the newly provided additional hands 512 that were provided as an "award" or other player benefit. In other words, such an embodiment enables the player to trade back awarded additional hands for other benefits (e.g. payout modifiers) that can be used in connection with retained hands.

Figure 6:
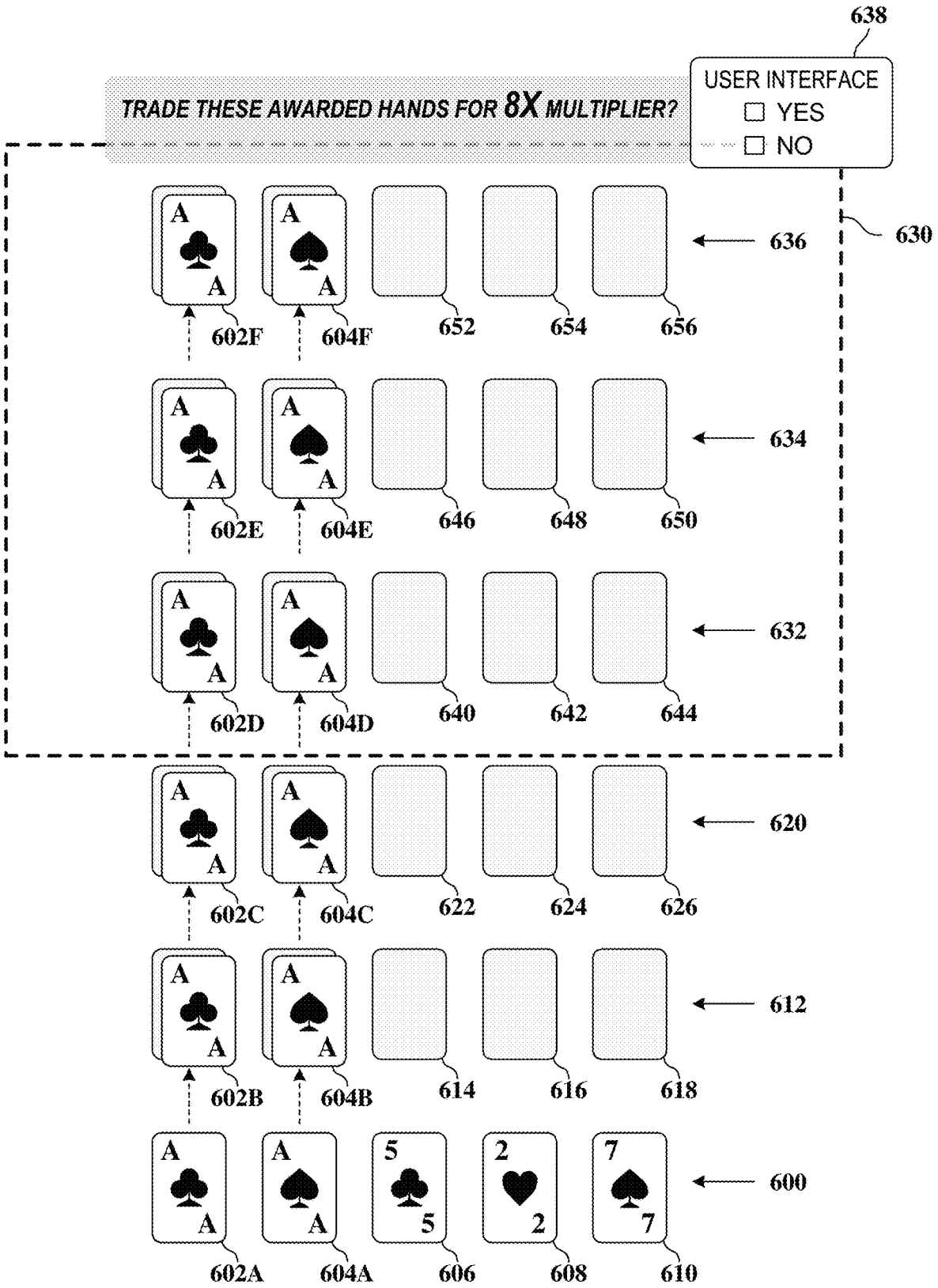
FIG. 6 depicts a triple-play poker example where one or more newly awarded hands may be traded for payout modifiers and/or other player assets for use with remaining active hands.

As previously noted, some embodiments involve providing an opportunity to trade back newly-awarded additional hands. FIG. 6 depicts a triple-play poker example where one or more awarded hands, provided in addition to the initial hand and standard concurrently-played hands, may be traded for payout modifiers and/or other player assets for use with remaining active hands. In this embodiment, an initial hand 600 is dealt (including cards 602A, 604A, 606, 608, 610), as well as the two additional concurrently-played hands 612, 620 that would naturally be included in a triple-play poker game.

Assume for purposes of this example that a pair of Aces in the initial hand 600 triggers an award of one or more awarded hands 630 that operate as the additional hands 612, 620 of the triple-play game operate. In other words, cards may be held in the initial hand 600, and those held cards are replicated into the other two hands 612, 620 associated with the triple-play poker game. Cards can then be drawn for the non-held cards in hands 600, 612 and 620, including cards 606, 608, 610, 614, 616, 618, 622, 624, and 626. Resulting hands can then be made via replacement cards for hands 600, 612, 620.

In this example, where a triggering event provides newly awarded hands 630, namely hands 632, 634 and 636 in this example, the player is afforded an opportunity to forego one or all of the hands 632, 634, 626 in exchange for a payout modifier and/or other player asset to apply to hand 600, and in other embodiments to apply to each hand 600, 612, 620. In one embodiment, a multiplier is provided in exchange for relinquished hands 632, 634, 636, and the multiplier value may be dependent on the number of awarded hands 630 that were traded. In other embodiments, the player may instead or alternatively trade one or more of the concurrently-played hands 612, 620. However, in the illustrated embodiment, the player can select via a user interface 638 whether to trade all of the newly-awarded hands 630 to receive an 8× multiplier (in this example). If the player accepts this trade, then hands 632, 634 and 636 would be relinquished (i.e. no longer available to the player to play), and an 8× multiplier would be applied to the payouts of each of the hands 600, 612, 620. In this manner, a player can trade away awarded bonus hands to receive in their place a payout modifier or other player asset.

If the player had opted not to make the trade, then hands 632, 634 and 636 would remain active, but the 8× multiplier, otherwise provided if the trade were made, would not be provided. In such case, the held cards 602A and 604A of initial hand 600 would further be replicated into hands 632, 634 and 636, as depicted by cards 602D, 604D, 602E, 604E, 602F and 604F, and replacement cards would then be drawn for the non-held cards in hands 632, 634, 636, including cards 640, 642, 644, 646, 648, 650, 652, 654 and 656. Thus, where additional hands 630 are provided, and the player does not accept the trade for, for example, a payout modifier, the additional hands 632, 634 and 636 are played as if they were additional concurrently-played hands of the multi-play poker game.

These and other embodiments relate to systems, apparatuses and methods for selectively exchanging one or more poker hands or other game segments for an opportunity to enhance the return on wager for other poker hands/game segments. In accordance with one multi-play poker embodiment, an apparatus is provided for enhancing payouts in a multi-hand electronic poker event. The apparatus includes a display that presents the multi-hand electronic poker event and an associated plurality of poker hands. A user interface includes at least one user input to enable the player to initiate the multi-hand electronic poker event, and to make exchange decisions. A wager input device is structured to identify and validate player assets, and to permit the player to play the multi-hand electronic poker event when the player assets are provided. A processor is configured to deal the poker hands, and, in one embodiment, to reveal cards of at least the first poker hand. The processor is further configured to facilitate holding any number of the cards of the first poker hand, and to facilitate discarding those cards of the first poker hand that were not held. The processor is further configured to determine whether a trade of one or more hands is warranted (e.g. based on wager criteria, cards in the initial and/or other dealt hands, random indicators, etc.). If so, the processor provides the player with an opportunity to trade one or more of the poker hands for another benefit, such as a payout modifier applicable to payouts of one or more of the other non-traded poker hands. If not, all poker hands remain available to play, but the player does not receive the payout modifier since no trade was made.

Figure 7A:
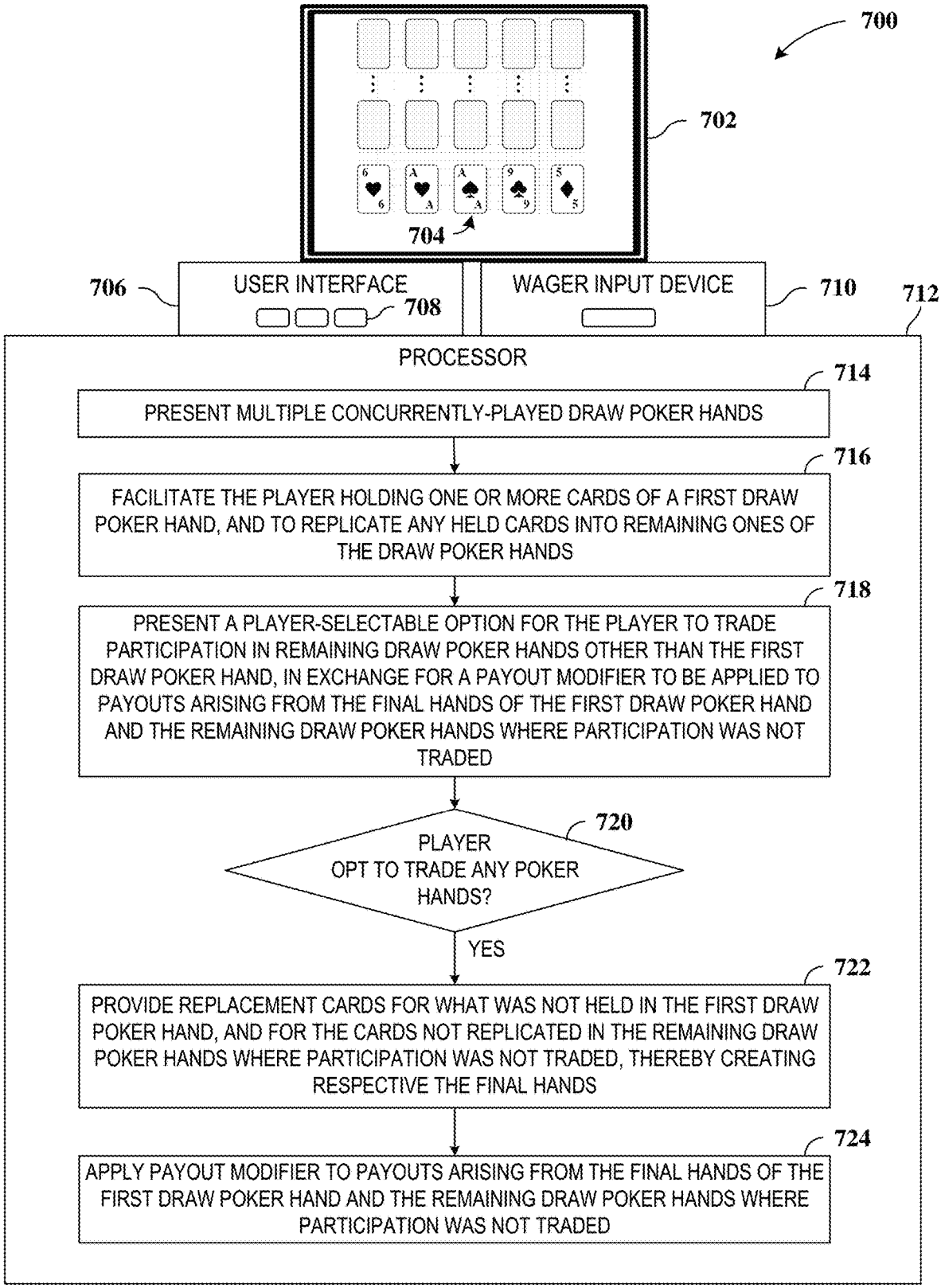
FIGS. 7A and 7B are block diagrams of representative alternative slot game apparatuses having software-programmed or otherwise designed/configured hardware for conditionally enhancing gaming payouts in accordance with the disclosure.
Figure 7B:
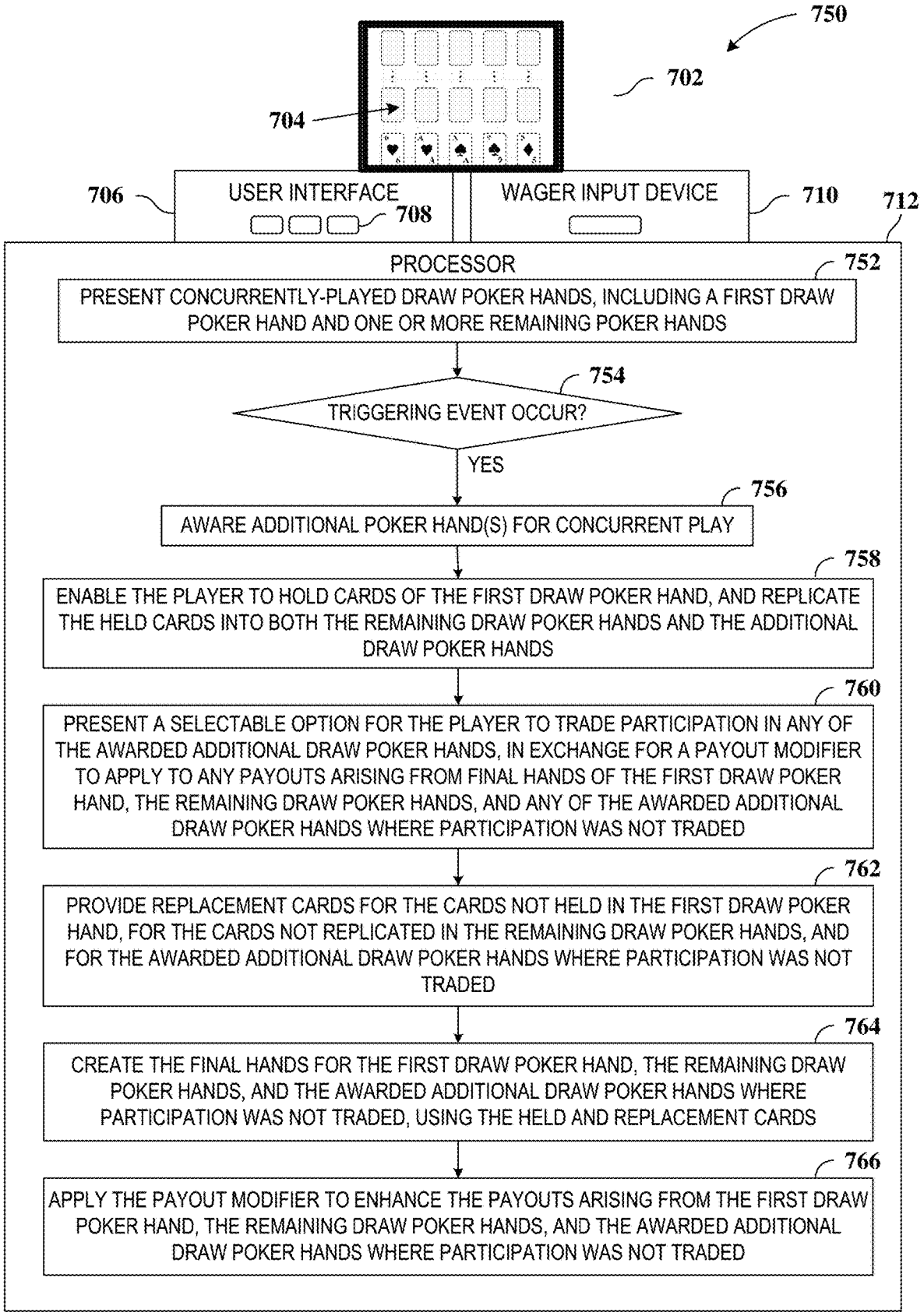

The functionality provided herein may be implemented in hardware on computing devices ranging from large gaming systems, stand-alone kiosks, to small personal devices. FIGS. 7A and 7B depict representative, illustrative video and/or electronic game embodiments where a processing arrangement (which is intended to include single processors, multiple processors, or any other processing arrangement) is programmed with software, firmware, or the like to provide various modules to perform functions described herein. The principles in FIGS. 7A and 7B are equally applicable to games other than video/electronic poker games, such as slot games, other card games, bingo, roulette, craps, or other games where exchanging awarded or otherwise available gaming segments for payout enhancement opportunities may be provided. In the representative examples of FIGS. 7A and 7B, each of the modules represents software-programmed or otherwise designed/configured hardware to carry out functions to facilitate the gaming features described herein.

FIGS. 7A and 7B are block diagrams of representative alternative slot game apparatuses having software-programmed or otherwise designed/configured hardware for conditionally enhancing gaming payouts in accordance with the disclosure.

Turning now to FIG. 7A, a block diagram is provided of a representative gaming apparatus 700 for facilitating exchanges of one or more concurrently-played poker hands for a player benefit(s) (e.g. a multiplier, higher paytable, etc.) that may increase or otherwise enhance payouts or other outcomes of the remaining, non-exchanged poker hands. In the embodiment of FIG. 7A, the gaming device/apparatus 700 for playing a poker game is provided. The representative gaming device 700 includes at least a display(s) 702 presenting a single or multiple poker hands 704, or other gaming event for other gaming activities (e.g. reels for slot games, etc.). A user interface 706 is provided that includes at least one user input 708 to enable a player to initiate and participate in poker hands 704 presented via the display 702. A wager input device 710 may be provided, which may be structured to identify and validate player assets and ultimately permit the player to play the poker game events when the player assets are provided. For purposes of illustration, the present example is described in terms of a multi-play poker game.

In the illustrated embodiment, the processor 712 is configured to cause the display 702 to visually present 714 multiple concurrently-played draw poker hands in response to the player assets being allocated via the wager input device 710. The processor 712 is configured to facilitate 716 the player holding one or more cards of a first one of the draw poker hands, and to replicate any held cards into remaining ones of the draw poker hands. The processor 712 is configured to present 718, via the display 702, a player-selectable option for the player to trade/exchange participation in one or more of the remaining draw poker hands other than the first draw poker hand, in exchange for a payout modifier to be applied to any payouts arising from the final (e.g. post-draw/post-replacement) hands of the first draw poker hand and the remaining draw poker hands where participation was not traded. The processor is configured to determine 720 whether the player opted to trade any poker hands. If so, the processor 712 is configured to provide 722 replacement cards for what was not held in the first draw poker hand, and to provide replacement cards for the cards not replicated in the remaining draw poker hands where participation was not traded, thereby creating the final hands of the first draw poker hand and the remaining draw poker hands where participation was not traded. The processor 712 is configured to apply 724 the payout modifier to the payouts arising from the final hands of the first draw poker hand and the remaining draw poker hands where participation was not traded.

Turning now to FIG. 7B, a block diagram is provided of a representative gaming apparatus 750 for facilitating exchanges of one or more additionally awarded poker hands for a player benefit(s) (e.g. a multiplier, higher paytable, etc.) that may increase or otherwise enhance payouts or other outcomes of the remaining, non-exchanged poker hands. In the embodiment of FIG. 7B, using reference numbers analogous to those of FIG. 7A where appropriate, the gaming device/apparatus 750 for playing a poker game is provided. The representative gaming device 750 includes at least a display(s) 702 presenting a single or multiple poker hands 704, or other gaming event for other gaming activities (e.g. reels for slot games, etc.). A user interface 706 is provided that includes at least one user input 708 to enable a player to initiate and participate in poker hands 704 presented via the display 702. A wager input device 710 may be provided, which may be structured to identify and validate player assets and ultimately permit the player to play the poker game events when the player assets are provided. For purposes of illustration, the present example is described in terms of a multi-play poker game.

In the illustrated embodiment, the processor 712 is configured to cause the display to visually present 752 multiple concurrently-played draw poker hands in response to the player assets being allocated via the wager input device, where the concurrently-played draw poker hands includes a first draw poker hand and one or more remaining draw poker hands. The processor is configured to determine 754 whether a triggering event occurred in connection with the first draw poker hand, and if so, to award 756 one or more additional draw poker hands for concurrent play. The processor 712 is configured to enable 758 or otherwise facilitate the player holding of zero, one, or more cards of the first draw poker hand, and to replicate any held cards into both the remaining draw poker hands and the additional draw poker hands. The processor 712 is further configured to present 760 a selectable option for the player to trade participation in one or more of the awarded additional draw poker hands, in exchange for a payout modifier to apply to any payouts arising from final hands of the first draw poker hand, the remaining draw poker hands, and any of the awarded additional draw poker hands where participation was not traded. The processor 712 is configured to provide 762 replacement cards for the cards that were not held in the first draw poker hand, for the cards that were not replicated in the remaining draw poker hands, and for the cards that were not replicated in the awarded additional draw poker hands where participation was not traded. The processor is configured to create 764 the final hands for the first draw poker hand, the remaining draw poker hands, and the awarded additional draw poker hands where participation was not traded, using the held and replacement cards. The processor 712 is further configured to apply 766 the payout modifier to enhance the payouts arising from the first draw poker hand, the remaining draw poker hands, and the awarded additional draw poker hands where participation was not traded.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention covers alternatives, modifications, and equivalents that come within the scope and spirit of the principles set out herein and/or in the appended claims.

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A gaming device for facilitating player participation in a poker game, comprising:

a display;

a user interface configured to receive at least player input to facilitate player participation in the poker game;

a wager input device structured to identify and validate player assets, and to permit the player to play the poker game when the player assets are provided; and a processor configured to:

cause the display to visually present a plurality of concurrently-played draw poker hands in response to player assets being allocated via the wager input device to participate in poker game;

facilitate the player holding of one or more cards of a first draw poker hand of the plurality of draw poker hands, and replicate the held one or more cards into remaining ones of the draw poker hands;

present a selectable option for the player to trade participation in one or more of remaining ones of the draw poker hands not including the first draw poker hand, in exchange for a payout modifier to apply to any payouts arising from final hands of the first draw poker hand and the remaining draw poker hands where participation was not traded;

provide replacement cards for the cards not held in the first draw poker hand, and for the cards not replicated in the remaining draw poker hands where participation was not traded, thereby creating the final hands of the first draw poker hand and the remaining draw poker hands where participation was not traded; and apply the payout modifier to the payouts arising from the final hands of the first draw poker hand and the remaining draw poker hands where participation was not traded.

2. The gaming device as in claim 1, wherein the payout modifier comprises a multiplier, and wherein the processor is configured to apply the multiplier to the payouts arising from the final hands of the first draw poker hand and the remaining draw poker hands where participation was not traded.

3. The gaming device as in claim 2, wherein a value of the multiplier is dependent on a number of the remaining ones of the draw poker hands that are traded.

4. The gaming device as in claim 2, wherein a value of the multiplier increases with an increasing number of the remaining ones of the draw poker hands that are traded.

5. The gaming device as in claim 1, wherein the processor is configured to present the selectable option for the player to trade in response to particular ones of the cards being presented in the first draw poker hand.

6. The gaming device as in claim 1, wherein the processor is configured to present the selectable option for the player to trade in response to a poker rank of the cards presented in the first draw poker hand.

7. The gaming device as in claim 1, wherein the processor is configured to randomly determine whether to present the selectable option for the player to trade.

8. The gaming device as in claim 1, wherein the processor is further configured to:

add one or more additional ones of the concurrently-played draw poker hands in response to particular cards being presented in the first draw poker hand; and present the selectable option for the player to trade participation in any of the remaining draw poker hands and the additional concurrently-played draw poker hands, in exchange for the payout modifier to apply to any of the payouts arising from the final hands of the first draw poker hand, the remaining draw poker hands where participation was not traded, and the additional concurrently-played draw poker hands where participation was not traded.

9. The gaming device as in claim 8, wherein the payout modifier increases as the number of the remaining draw poker hands and the additional concurrently-played draw poker hands that are traded increases.

10. The gaming device as in claim 1, wherein the processor is configured to provide no payout modifier if the player chooses not to trade any of the remaining ones of the draw poker hands not including the first draw poker hand.

11. A gaming device for facilitating player participation in a poker game, comprising:

a display;

a user interface configured to receive at least player input to facilitate player participation in the poker game;

a wager input device structured to identify and validate player assets, and to permit the player to play the poker game when the player assets are provided; and a processor configured to:

cause the display to visually present a plurality of concurrently-played draw poker hands in response to player assets being allocated via the wager input device to participate in the poker game, the plurality of concurrently-played draw poker hands including a first draw poker hand and one or more remaining draw poker hands;

determine whether a triggering event occurred in connection with the first draw poker hand, and if that the triggering event is determined to have occurred, award one or more concurrently-played additional draw poker hands;

facilitate the player holding of one or more cards of the first draw poker hand, and replicate the held one or more cards into the remaining draw poker hands and the additional draw poker hands;

present a selectable option for the player to trade participation in one or more of the awarded additional draw poker hands, in exchange for a payout modifier to apply to any payouts arising from final hands of the first draw poker hand, the remaining draw poker hands, and any of the awarded additional draw poker hands where participation was not traded;

provide replacement cards for the cards not held in the first draw poker hand, for the cards not replicated in the remaining draw poker hands, and for the cards not replicated in the awarded additional draw poker hands where participation was not traded;

using the held and replacement cards, create the final hands for the first draw poker hand, the remaining draw poker hands, and the awarded additional draw poker hands where participation was not traded; and apply the payout modifier to enhance the payouts arising from the first draw poker hand, the remaining draw poker hands, and the awarded additional draw poker hands where participation was not traded.

12. The gaming device as in claim 11, wherein the processor is configured to:

cause the display to present the selectable option for the player to additionally trade participation in one or more of the remaining draw hands, in exchange for the payout modifier to apply to any payouts arising from the final hands of the first draw poker hand, the remaining draw poker hands, and any of the awarded additional draw poker hands where participation was not traded; and apply the payout modifier to enhance the payouts arising from the final hands of the first draw poker hand, the remaining draw poker hands where participation was not traded, and the awarded additional draw poker hands where participation was not traded.

13. The gaming device as in claim 12, wherein the payout modifier comprises a multiplier, and wherein the processor is configured to apply the multiplier to the payouts arising from the final hands of the first draw poker hand, the remaining draw poker hands where participation was not traded, and the awarded additional draw poker hands where participation was not traded.

14. The gaming device as in claim 11, wherein the payout modifier comprises a multiplier, and wherein the processor is configured to apply the multiplier to the payouts arising from the final hands of the first draw poker hand, and arising from the awarded additional draw poker hands where participation was not traded.

15. The gaming device as in claim 14, wherein a value of the multiplier is dependent on a number of the awarded additional draw poker hands that are traded.

16. The gaming device as in claim 14, wherein a value of the multiplier increases with an increasing number of the awarded additional draw poker hands that are traded.

17. The gaming device as in claim 11, wherein the processor is configured to present the selectable option for the player to trade in response to particular ones of the cards being presented in the first draw poker hand.

18. The gaming device as in claim 11, wherein the processor is configured to present the selectable option for the player to trade in response to a poker rank of the cards presented in the first draw poker hand.

19. The gaming device as in claim 11, wherein the processor is configured to randomly determine whether to present the selectable option for the player to trade.

20. The gaming device as in claim 11, wherein the processor is configured to provide no additional draw poker hands if it is determined that the triggering event did not occur.

* * * * *